US012729422B2

(12) United States Patent
Sato et al.

(10) Patent No.: US 12,729,422 B2
(45) Date of Patent: Sep. 8, 2026

(54) HOT PRESSED MEMBER AND HOT PRESS FORMING STEEL SHEET, AND METHODS OF PRODUCING SAME

(71) Applicant: JFE STEEL CORPORATION, Tokyo (JP)

(72) Inventors: Rinta Sato, Tokyo (JP); Yoichi Makimizu, Tokyo (JP); Ryoto Nishiike, Tokyo (JP); Minoru Tanaka, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 18/839,142

(22) PCT Filed: Jan. 5, 2023

(86) PCT No.: PCT/JP2023/000108
§ 371 (c)(1),
(2) Date: Aug. 16, 2024

(87) PCT Pub. No.: WO2023/176100
PCT Pub. Date: Sep. 21, 2023

(65) Prior Publication Data

US 2025/0163558 A1 May 22, 2025

(30) Foreign Application Priority Data

Mar. 14, 2022 (JP) ..... 2022-039631

(51) Int. Cl.

| | |
|---|---|
| ***C23C 2/12*** | (2006.01) |
| ***C22C 21/00*** | (2006.01) |
| ***C22C 21/08*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/28*** | (2006.01) |
| ***C22C 38/32*** | (2006.01) |
| ***C22C 38/60*** | (2006.01) |
| ***C23C 2/20*** | (2006.01) |
| ***C23C 2/28*** | (2006.01) |

(52) U.S. Cl.
CPC ..... *C23C 2/12* (2013.01); *C22C 21/00* (2013.01); *C22C 21/08* (2013.01); *C22C 38/001* (2013.01); *C22C 38/002* (2013.01); *C22C 38/02* (2013.01); *C22C 38/04* (2013.01); *C22C 38/06* (2013.01); *C22C 38/28* (2013.01); *C22C 38/32* (2013.01); *C22C 38/60* (2013.01); *C23C 2/20* (2013.01); *C23C 2/29* (2022.08)

(58) Field of Classification Search
CPC ..... C23C 2/12; C22C 21/08; C22C 21/00
USPC ..... 428/632
See application file for complete search history.

(56) References Cited

U.S. PATENT DOCUMENTS

| | | | |
|---|---|---|---|
| 2014/0377583 | A1 | 12/2014 | Tsuru et al. |
| 2017/0260601 | A1 | 9/2017 | Banik et al. |
| 2020/0032360 | A1 | 1/2020 | Sengoku et al. |
| 2020/0032381 | A1 | 1/2020 | Sato et al. |
| 2020/0255916 | A1 | 8/2020 | Banik et al. |
| 2022/0025480 | A1 | 1/2022 | Remy et al. |
| 2022/0048277 | A1 | 2/2022 | Oh et al. |

FOREIGN PATENT DOCUMENTS

| | | | |
|---|---|---|---|
| CN | 103975089 | A | 8/2014 |
| CN | 110352261 | A | 10/2019 |
| EP | 2792764 | A1 | 10/2014 |
| EP | 3604602 | A1 | 2/2020 |
| JP | 2022012959 | A | 2/2002 |
| JP | 2003034845 | A | 2/2003 |
| JP | 2010168645 | A | 8/2010 |
| JP | 2017536472 | A | 12/2017 |
| JP | 2022513667 | A | 2/2022 |
| KR | 102365408 | B1 | 2/2022 |
| WO | 2013089262 | A1 | 6/2013 |
| WO | 2018179395 | A1 | 10/2018 |
| WO | 2018181392 | A1 | 10/2018 |
| WO | 2022039275 | A1 | 2/2022 |

OTHER PUBLICATIONS

Sep. 26, 2024, the Extended European Search Report issued by the European Patent Office in the corresponding European Patent Application No. 23770064.6.

Apr. 4, 2023, International Search Report issued in the International Patent Application No. PCT/JP2023/000108.

Feb. 6, 2024, Notification of Reasons for Refusal issued by the Japan Patent Office in the corresponding Japanese Patent Application No. 2023-526685 with English language Concise Statement of Relevance.

Feb. 1, 2026, Office Action issued by the Ministry of Intellectual Property in the corresponding Korean Patent Application No. 10-2024-7024180 with English language concise statement of relevance.

Jun. 17, 2026, Office Action issued by the China National Intellectua Property Administration in the corresponding Chinese Patent Application No. 202380025000.4 with English language search report.

*Primary Examiner* — Katherine A Christy
(74) *Attorney, Agent, or Firm* — KENJA IP LAW PC

(57) ABSTRACT

A hot pressed member includes: a steel material; an Al—Fe-based intermetallic compound layer with a thickness of 10 μm to 30 μm disposed on at least one side of the steel material; and Mg-containing oxide particles disposed on the Al—Fe-based intermetallic compound layer, wherein the Mg-containing oxide particles have an average particle size of 5.0 μm or less and a number density of 1000 particles/$mm^2$ or more.

2 Claims, No Drawings

HOT PRESSED MEMBER AND HOT PRESS FORMING STEEL SHEET, AND METHODS OF PRODUCING SAME

TECHNICAL FIELD

The present disclosure relates to a hot pressed member and a hot press forming steel sheet, and methods of producing the same.

BACKGROUND

In recent years, it has been promoted to increase performance and reduce weight of blank sheets in the automotive field, and the use of high-strength hot-dip galvanized steel sheets or electrogalvanized steel sheets with rust resistance has been increasing. In many cases, however, as steel sheets become stronger, their press formability decreases, thus making it difficult to obtain complex part shapes. Examples of parts for automotive applications that require rust resistance and are difficult to make include suspension members, such as chassis, and structural members of framework, such as B-pillars.

In light of the above background, recent years have seen a rapid increase in automotive part production by hot pressing, which can easily achieve both press formability and high strength in comparison with cold pressing. In particular, aluminum or aluminum alloy-coated steel sheets have attracted attention as hot press forming steel sheets due to their excellent oxidation resistance at high temperatures, and various aluminum or aluminum alloy-coated steel sheets suitable for hot pressing and hot pressed members using the aluminum or aluminum alloy-coated steel sheets have been proposed.

For example, Patent Literature (PTL) 1 proposes a hot press forming aluminum or aluminum alloy-coated steel sheet that includes an aluminum or aluminum alloy coating layer containing 1 mass % to 15 mass % Si and 0.5 mass % to 10 mass % Mg.

CITATION LIST

Patent Literature

PTL 1: JP 2003-034845 A

SUMMARY

Technical Problem

According to PTL 1, using a hot press forming steel sheet that includes the above aluminum or aluminum alloy coating layer can reduce cracking of the coating layer during hot pressing and also improve corrosion resistance.

Nevertheless, the present inventors have studied and found that hot pressed members obtained by conventional techniques, such as PTL 1, are still insufficient in terms of post-painting corrosion resistance and corrosion resistance at lapped part.

That is, hot press forming steel sheets are generally hot pressed and then used in a painted state. It is therefore necessary for the hot press forming steel sheets to impart excellent post-painting corrosion resistance to the final hot pressed members.

Furthermore, hot pressed members used for automotive members or the like are generally welded to zinc or zinc alloy-coated steel sheets in use. Such welded portions are required to have excellent corrosion resistance because painting does not go around them. In addition, even in a case in which the hot press members themselves have excellent corrosion resistance, when corrosion occurs on the zinc or zinc alloy-coated steel sheets as mating members, hydrogen is generated and penetrates as a result of corrosion, thus possibly resulting in delayed fracture of the hot pressed members. Therefore, when being welded to the zinc or zinc alloy-coated steel sheets, the hot pressed members are required to reduce corrosion of the zinc or zinc alloy-coated steel sheets at the lapped parts, that is, to provide excellent corrosion resistance at lapped part.

It would be helpful to provide a hot pressed member with excellent post-painting corrosion resistance and excellent corrosion resistance at lapped part.

Solution to Problem

In order to solve the above problem, the present inventors have conducted studies and found the following.

(1) Disposing Mg-containing oxide particles with an average particle size of 5.0 μm or less in a predetermined number density on an Al—Fe-based intermetallic compound layer of a hot pressed member can reduce the corrosion rate of a zinc or zinc alloy-coated steel sheet at the lapped part.

(2) A hot pressed member that satisfies the condition (1) above can be obtained, by hot pressing a hot press forming steel sheet that includes an intermetallic compound layer consisting of a predetermined intermetallic compound and a metal layer containing Al—$Mg_2Si$ pseudo binary eutectic microstructures with a cross-sectional area ratio of 60% or more on a base steel sheet.

The present disclosure is based on the above findings and is summarized as follows.

1. A hot pressed member including:

a steel material;

an Al—Fe-based intermetallic compound layer with a thickness of 10 μm to 30 μm disposed on at least one side of the steel material; and Mg-containing oxide particles disposed on the Al—Fe-based intermetallic compound layer, wherein the Mg-containing oxide particles have an average particle size of 5.0 μm or less and a number density of 1000 particles/$mm^2$ or more.

2. A hot press forming steel sheet including:

a steel sheet; and a coating layer with a thickness of 10 μm to 30 μm disposed on at least one side of the steel sheet, wherein the coating layer includes:

an intermetallic compound layer consisting of at least one selected from the group consisting of $Fe_2Al_5$, $Fe_2Al_5Si$, $Fe_4Al_{13}$, and $FeAl_3$ and disposed on the steel sheet; and a metal layer containing Al—$Mg_2Si$ pseudo binary eutectic microstructures and disposed on the intermetallic compound layer, and wherein the Al—$Mg_2Si$ pseudo binary eutectic microstructures in the metal layer have a cross-sectional area ratio of 60% or more.

3. A method of producing a hot pressed member, the method including hot pressing the hot press forming steel sheet according to claim 2.

4. A method of producing a hot press forming steel sheet, the method including:

immersing a steel sheet into a hot dip molten bath and removing the steel sheet; and subsequently cooling the steel sheet at an average cooling rate of 15° C./s or more, wherein the hot dip molten bath has a chemical composition containing (consisting of), in mass %, Si: 3% to 7%, Mg: 6% to 12%, and Fe: 0% to 10%, with the balance being Al and inevitable impurities, where Mg/Si, which is a mass percent concentration ratio of Mg and Si, is 1.1 to 3.0.

Advantageous Effect

According to the present disclosure, a hot pressed member with excellent post-painting corrosion resistance and excellent corrosion resistance at lapped part can be provided.

DETAILED DESCRIPTION

In the following, an embodiment of the present disclosure will be described. The following merely provides a preferred embodiment of the present disclosure, and the present disclosure is by no means limited to the disclosed embodiment. The unit of content "%" represents "mass %" unless otherwise specified.

(1) Hot Pressed Member

A hot pressed member in an embodiment of the present disclosure includes a steel material as a base metal, an Al—Fe-based intermetallic compound layer disposed on at least one side of the steel material, and Mg-containing oxide particles disposed on the Al—Fe-based intermetallic compound layer. Each component will be described below.

[Steel Material]

The present disclosure solves the above problem, by providing the Al—Fe-based intermetallic compound layer and the Mg-containing oxide particles that satisfy predetermined conditions on a surface of the steel material, as will be described below. Therefore, any steel material can be used as the steel material without any particular limitation.

Additionally, the hot pressed member according to the present disclosure is produced by hot pressing a hot press forming steel sheet as will be described below. It can therefore be said that the steel material is a steel sheet formed by hot pressing. Both a cold-rolled steel sheet and a hot-rolled steel sheet can be used as the steel sheet.

From the viewpoint of use as an automotive member, it is preferable for the hot pressed member to have high strength. In particular, in order to obtain a hot pressed member that exceeds the 980 MPa class in tensile strength, it is preferable to use a steel material with the following chemical composition.

The chemical composition containing

C: 0.05% to 0.50%,

Si: 0.1% to 0.5%,

Mn: 0.5% to 3.00%,

P: 0.1% or less,

S: 0.01% or less,

Al: 0.10% or less, and

N: 0.01% or less, with the balance being Fe and inevitable impurities.

In the following, the actions and effects and the optimal contents of the respective elements in the aforementioned preferred chemical composition will be described.

C: 0.05% to 0.50%

C is an element that has the effect of increasing strength by forming microstructures, such as martensite. From the viewpoint of obtaining strength exceeding the 980 MPa class, the C content is set preferably to 0.05% or more, and more preferably to 0.10% or more. On the other hand, when the C content exceeds 0.50%, the toughness of spot welded portion deteriorates. The C content is therefore set preferably to 0.50% or less, more preferably to 0.45% or less, even more preferably to 0.43% or less, and most preferably to 0.40% or less.

Si: 0.1% to 0.5%

Si is an effective element in strengthening steel so as to obtain good material properties. To achieve the effect, the Si content is set preferably to 0.1% or more, and more preferably to 0.2% or more. On the other hand, when the Si content exceeds 0.5%, ferrite is stabilized, and quench hardenability decreases. The Si content is therefore set preferably to 0.5% or less, more preferably to 0.4% or less, and even more preferably to 0.3% or less.

Mn: 0.5% to 3.0%

Mn is an effective element for obtaining high strength regardless of cooling rate. From the viewpoint of ensuring excellent mechanical properties and strength, the Mn content is set preferably to 0.5% or more, more preferably to 0.7% or more, and even more preferably to 1.0% or more. On the other hand, when the Mn content exceeds 3.0%, the cost increases, and moreover, the effect of adding Mn becomes saturated. The Mn content is therefore set preferably to 3.0% or less, more preferably to 2.5% or less, even more preferably to 2.0% or less, and most preferably to 1.5% or less.

P: 0.1% or Less

An excessive P content degrades local ductility due to grain boundary embrittlement caused by P segregation to austenite grain boundaries during casting. As a result, the balance between strength and ductility of the steel sheet decreases. Accordingly, from the viewpoint of improving the balance between strength and ductility of the steel sheet, it is preferable to set the P content to 0.1% or less. On the other hand, the lower limit of the P content is not particularly limited and may be 0%, but from the viewpoint of refining cost, it is preferable to set the P content to 0.01% or more.

S: 0.01% or Less

S acts as an inclusion, such as MnS, and causes degradation in anti-crash properties and cracks generated along metal flow in the welded portion. It is therefore desirable to reduce the S content as much as possible, and specifically, the S content is preferably set to 0.01% or less. Furthermore, from the viewpoint of ensuring good stretch flangeability, the S content is set more preferably to 0.005% or less, and even more preferably to 0.001% or less. On the other hand, the lower limit of S content is not particularly limited and may be 0%, but from the viewpoint of refining cost, it is preferable to set the S content to 0.0002% or more.

Al: 0.10% or Less

Al is an element that acts as a deoxidizer. However, when the Al content exceeds 0.10%, the blanking workability and hardenability of the material steel sheet decreases. The Al content is therefore set preferably to 0.10% or less, more preferably to 0.07% or less, and even more preferably to 0.04% or less. On the other hand, the lower limit of the Al content is not particularly limited, but from the viewpoint of ensuring the effect as a deoxidizing material, it is preferable to set the Al content to 0.01% or more.

N: 0.01% or Less

When the N content exceeds 0.01%, AlN nitrides are formed during hot rolling or heating before hot pressing, and the blanking workability and hardenability of the material steel sheet decrease. It is therefore preferable to set the N content to 0.01% or less. On the other hand, the lower limit of the N content is not particularly limited and may be 0%, but from the viewpoint of refining cost, it is preferable to set the N content to 0.001% or more.

Furthermore, the above chemical composition may also optionally contain at least one selected from the group consisting of Nb: 0.10% or less, Ti: 0.05% or less, B: 0.0002% to 0.005%

Cr: 0.1% to 1.0%, and

Sb: 0.003% to 0.03%.

Nb: 0.10% or Less

Nb is an effective component for strengthening steel, but its excessive content increases rolling load. Accordingly, in a case in which Nb is added, the Nb content is set preferably to 0.10% or less, and more preferably to 0.05% or less. On the other hand, the lower limit of the Nb content is not particularly limited and may be 0%, but from the viewpoint of refining cost, it is preferable to set the Nb content to 0.005% or more.

Ti: 0.05% or Less

Similarly to Nb, Ti is an effective component for strengthening steel, but its excessive content reduces shape fixability. Accordingly, in a case in which Ti is added, the Ti content is set preferably to 0.05% or less, and more preferably to 0.03% or less. On the other hand, the lower limit of the Ti content is not particularly limited and may be 0%, but from the viewpoint of refining cost, it is preferable to set the Ti content to 0.005% or more.

B: 0.0002% to 0.005%

B has the effect of reducing the formation and growth of ferrite from austenite grain boundaries. In a case in which B is added, the B content is set preferably to 0.0002% or more so as to obtain the effect, and more preferably to 0.0010% or more. On the other hand, excessive addition of B decreases formability. Accordingly, in a case in which B is added, the B content is set preferably to 0.005% or less, and more preferably to 0.003% or less.

Cr: 0.1% to 1.0%

Similarly to Mn, Cr is a useful element for strengthening steel and improving quench hardenability. In a case in which Cr is added, the Cr content is set preferably to 0.1% or more so as to obtain the effect, and more preferably to 0.2% or more. On the other hand, Cr is an expensive element, so the addition of excessive Cr can significantly increase the cost. Accordingly, in a case in which Cr is added, the Cr content is set preferably to 1.0% or less, and more preferably to 0.2% or less.

Sb: 0.003% to 0.03%

Sb is an element that has the effect of prevent decarburization of a surface layer of the steel sheet during an annealing process in the production of the base steel sheet. In a case in which Sb is added, the Sb content is set preferably to 0.003% or more so as to obtain the effect, and more preferably to 0.005% or more. On the other hand, when the Sb content exceeds 0.03%, the rolling load increases, thus resulting in lower productivity. Accordingly, in a case in which Sb is added, the Sb content is set preferably to 0.03% or less, more preferably to 0.02% or less, and even more preferably to 0.01% or less.

[Al—Fe-Based Intermetallic Compound Layer]

The hot pressed member according to the present disclosure includes the Al—Fe-based intermetallic compound layer on at least one side of the steel material. Providing a layer consisting of an Al—Fe-based intermetallic compound on a surface of the hot pressed member can reduce corrosion from areas, such as scratched portions of a painting film or edges of the painting, where the rust-resistant function by the painting film has decreased, thus preventing the generation and entry of hydrogen due to corrosion.

Additionally, the hot pressed member according to the present disclosure may further include an α-Fe layer using Al as a solute between the Al—Fe-based intermetallic compound layer and the steel material (base metal). The α-Fe layer can be clearly distinguished from the Al—Fe-based intermetallic compound layer by the contrast difference on a scanning electron microscope (SEM) reflected electron image.

Although the Al—Fe-based intermetallic compound layer may be provided on at least one side of the steel material, it is preferably provided on both sides.

The Al—Fe-based intermetallic compound contained in the Al—Fe-based intermetallic compound layer is not limited to a particular type, but examples may include $FeAl_3$, $Fe_4Al_{13}$, $Fe_2Al_5$, FeAl, and $Fe_3Al$. Furthermore, the Al—Fe-based intermetallic compound layer can also contain an Al—Fe—Si-based intermetallic compound, such as $Fe_2Al_5Si$. That is, the Al—Fe-based intermetallic compound layer in an embodiment of the present disclosure may be a layer containing at least one selected from the group consisting of $FeAl_3$, $Fe_4Al_{13}$, $Fe_2Al_5$, FeAl, $Fe_3Al$, and $Fe_2Al_5Si$, and it may be a layer consisting of least one selected from the group consisting of $FeAl_3$, $Fe_4Al_{13}$, $Fe_2Al_5$, FeAl, $Fe_3Al$, and $Fe_2Al_5Si$.

Thickness: 10 μm to 30 μm

When the thickness of the Al—Fe-based intermetallic compound layer is less than 10 μm, desired post-painting corrosion resistance cannot be obtained. Accordingly, the thickness of the Al—Fe-based intermetallic compound layer is set preferably to 10 μm or more, more preferably to 13 μm or more, and even more preferably to 15 μm or more. On the other hand, when the thickness of the Al—Fe-based intermetallic compound layer exceeds 30 μm, the intermetallic compound layer may detach from the hot pressed member due to decreased adhesion of the intermetallic compound layer. Accordingly, the thickness of the Al—Fe-based intermetallic compound layer is set to 30 μm or less, preferably to 28 μm or less, and more preferably to 25 μm or less. Here, the thickness of the Al—Fe-based intermetallic compound layer is defined as the thickness per side of the steel material.

The thickness of the Al—Fe-based intermetallic compound layer can be adjusted, by controlling the thickness of the coating layer of the hot press forming steel sheet used to produce the hot pressed member and conditions of hot pressing.

The thickness of the Al—Fe-based intermetallic compound layer can be measured by SEM observation of a cross-section of the hot pressed member. More specifically, it can be measured by a method described in Examples. In a case in which the Al—Fe-based intermetallic compound layer is provided on both sides of the steel material, the thickness of the Al—Fe-based intermetallic compound layer on each side is 10 μm to 30 μm. However, the thickness of the Al—Fe-based intermetallic compound layer on one side may be the same as or different from the thickness of the Al—Fe-based intermetallic compound layer on the other side.

[Mg-Containing Oxide Particles]

The hot pressed member according to the present disclosure includes Mg-containing oxide particles (hereinafter, may be simply referred to as "oxide particles") on a surface of the Al—Fe-based intermetallic compound layer. The oxide particles can improve corrosion resistance. In particular, Mg-containing oxide particles exhibit a pH buffering effect in steel sheet lapped parts in which chlorides tend to stay, and thus can reduce the corrosion rate of Al—Fe-based intermetallic compounds, which have a high corrosion rate in acidic environments. Furthermore, in a case in which a zinc or zinc alloy-coated steel sheet is used as a welding mating member, the corrosion rate of the zinc or zinc alloy-coated layer can be reduced.

Average Particle Size: 5.0 μm or Less

When the average particle size of Mg-containing oxide particles exceeds 5.0 μm, desired post-painting corrosion resistance cannot be obtained. This is because the thickness of the painting film is insufficient in areas where coarse oxide particles are present. Accordingly, the average particle size of Mg-containing oxide particles is set to 5.0 μm or less, preferably to 4.0 μm or less, and more preferably to 3.0 μm or less. On the other hand, the lower limit of the average particle size is not particularly limited, but when it is less than 0.1 μm, the corrosion resistance at lapped part may decrease. Accordingly, from the viewpoint of further ensuring stable corrosion resistance at lapped part, it is preferable to set the average particle size of Mg-containing oxide particles to 0.1 μm or more.

Number Density: 1000 Particles/$mm^2$ or More

The effect of Mg-containing oxide particles to improve post-painting corrosion resistance depends on the number density of the oxide particles. When the number density of the oxide particles is less than 1000 particles/$mm^2$, desired corrosion resistance cannot be ensured. The number density of the Mg-containing oxide particles is therefore set to 1000 particles/$mm^2$ or more, preferably to 1500 particles/$mm^2$ or more, and more preferably to 2000 particles/$mm^2$ or more. On the other hand, the upper limit of the number density is not particularly limited, but when the number density exceeds 20000/$mm^2$, the improvement effect of post-painting corrosion resistance may become saturated, and besides, weldability may deteriorate instead. Accordingly, the number density of the Mg-containing oxide particles is set preferably to 20000 particles/$mm^2$ or less, and more preferably to 10000 particles/$mm^2$ or less.

The average particle size and the number density of Mg-containing oxide particles can be measured by observing a surface of the hot pressed member with a scanning electron microscope (SEM). More specifically, they can be measured by the method described in Examples. Additionally, the Mg-containing oxide particles are observed as darker areas than the steel material by adjusting the contrast of reflected electron images.

The strength of the hot pressed member is not particularly limited, but it is desirable to have high strength because hot-pressed members are generally used in applications that require strength, such as automotive parts. In particular, tensile strength more than 900 MPa is required for framework parts, such as center pillars, that reduce deformation caused by collision. Accordingly, the tensile strength of the hot pressed member is preferably more than 900 MPa, more preferably more than 1200 MPa, and even more preferably more than 1470 MPa. On the other hand, the upper limit of the tensile strength is also not particularly limited, but it may generally be 2600 MPa or less. When the tensile strength exceeds 2600 MPa, toughness is significantly decreased, thus making it difficult to apply it as an automotive member.

When being used as a part, such as a side member, that is required to absorb energy, the hot pressed member is required to have excellent yield stress and elongation. Accordingly, the yield stress of the hot pressed member is preferably more than 700 MPa. On the other hand, the upper limit of the yield stress is also not particularly limited, but it may generally be 2000 MPa or less.

Additionally, the total elongation of the hot pressed member is preferably more than 4%. On the other hand, the upper limit of the total elongation is also not particularly limited, but it may generally be 10% or less.

(2) Hot Press Forming Steel Sheet

A hot press forming steel sheet in an embodiment of the present disclosure includes a steel sheet and a coating layer disposed on at least one side of the steel sheet. Furthermore, the coating layer includes an intermetallic compound layer consisting of at least one selected from the group consisting of $Fe_2Al_5$, $Fe_2Al_5Si$, $Fe_4Al_{13}$, and $FeAl_3$ and is disposed on the steel sheet, and a metal layer containing Al—$Mg_2Si$ pseudo binary eutectic microstructures and is disposed on the intermetallic compound layer. Additionally, the "metal layer" is defined here as a layer consisting of metal and inevitable impurities, and the metal includes alloy and intermetallic compounds.

[Intermetallic Compound Layer]

The hot press forming steel sheet according to the present disclosure is typically produced by subjecting the steel sheet to hot dip coating as will be described later. At this time, Fe contained in the steel sheet reacts with components, such as Al and Si, contained in the molten bath, thus forming an intermetallic compound layer at the interface between the steel sheet and the metal layer. There are various types of Al—Fe-based or Al—Fe—Si-based intermetallic compounds, among which $Fe_2Al_5$, $Fe_2Al_5Si$, $Fe_4Al_{13}$, and $FeAl_3$ have low hardness. Accordingly, by providing the intermetallic compound layer consisting of at least one selected from the group consisting of $Fe_2Al_5$, $Fe_2Al_5Si$, $Fe_4Al_{13}$, and $FeAl_3$, the adhesion of the coating layer is improved, and the detachment of the coating layer can be prevented during cold blanking, for example.

[Metal Layer]

As mentioned above, with the Mg-containing oxide particles having an average particle size of 5.0 μm or less that are disposed on a surface, the hot pressed member according to the present disclosure provides excellent corrosion resistance. The present inventors have found that the Mg-containing oxide particles with an average particle size of 5.0 μm or less can be formed on the surface of the hot pressed member, when Al—$Mg_2Si$ pseudo binary eutectic microstructures are present in the metal layer of the hot press forming steel sheet. The reasons for this may be as follows.

That is, when the hot press forming steel sheet including the coating layer is heated, components contained in the coating layer are oxidized by oxygen or water in the atmosphere, and oxides are formed on a surface of the hot pressed member. In a case in which the coating layer contains Al, Mg, and Si, the most easily oxidized element among these components, that is, Mg is preferentially oxidized, thus resulting in the formation of Mg-containing oxides on the surface of the hot pressed member.

At this time, in a case in which Mg in the coating layer is present as a single phase $Mg_2Si$, coarse Mg-containing oxide particles with an average particle size more than 5.0

μm are formed on the surface of the hot pressed member. On the other hand, in a case in which Mg in the coating layer is present as eutectic microstructures of Al—$Mg_2Si$, $Mg_2Si$ is dispersed in the Al matrix in a very fine form (generally as particles with a particle size of 1 μm or less). Accordingly, even when agglomeration progresses during the process of undergoing oxidation, fine Mg-containing oxide particles with an average particle size of 5.0 μm or less can be formed on the surface of the final hot pressed member. Besides, the number density of the Mg-containing oxide particles is also increased because the Mg-containing oxide particles are refined.

Cross-Sectional Area Ratio: 60% or More

A low ratio of Al—$Mg_2Si$ pseudo binary eutectic microstructures in the metal layer increases the average particle size of Mg-containing oxide particles in the hot pressed member and decreases the number density of the Mg-containing oxide particles. Accordingly, the cross-sectional area ratio of the Al—$Mg_2Si$ pseudo binary eutectic microstructures in the metal layer is set to 60% or more, and preferably to 70% or more. On the other hand, because the higher the cross-sectional area ratio, the better, the upper limit is not particularly limited and may be 100%. From the viewpoint of ease of production, the cross-sectional area ratio may be 95% or less and even may be 90% or less.

It is sufficient for the metal layer to contain Al—$Mg_2Si$ pseudo binary eutectic microstructures with a cross-sectional area ratio of 60% or more, without particular limitations on other components. For example, the metal layer may contain at least one selected from the group consisting of an Al phase, $Mg_2Si$, and an Al—Fe-based intermetallic compound, in addition to the Al—$Mg_2Si$ pseudo binary eutectic microstructures. However, as mentioned above, the presence of single-phase $Mg_2Si$ tends to generate coarse Mg-containing oxide particles in that area. Accordingly, from the viewpoint of further preventing the generation of coarse Mg-containing oxide particles and further improving post-painting corrosion resistance, it is preferable that the metal layer does not contain single-phase $Mg_2Si$. The Al—Fe-based intermetallic compound can include, for example, at least one selected from the group consisting of $Fe_2Al_5$, $Fe_2Al_5Si$, $Fe_4Al_{13}$, and $FeAl_3$.

The cross-sectional area ratio of Al—$Mg_2Si$ pseudo binary eutectic microstructures in the metal layer can be determined by image interpretation of an image obtained by observing a cross-section of the hot press forming steel sheet with an SEM. More specifically, it can be measured by the method described in Examples.

Thickness of Coating Layer: 10 μm to 30 μm

When the thickness of the coating layer is less than 10 μm, the thickness of the Al—Fe-based intermetallic compound layer in the final hot pressed member is insufficient. As a result, in addition to insufficient corrosion resistance, the amount of hydrogen entry due to corrosion increases, and delayed fracture resistance decreases. Accordingly, the thickness of the coating layer is set to 10 μm or more, preferably to 12 μm or more, and more preferably to 15 μm or more. On the other hand, when the thickness of the coating layer exceeds 30 μm, hydrogen that enters the base steel sheet during the production process cannot easily escape after hot pressing, which is unfavorable in terms of delayed fracture. Accordingly, the thickness of the coating layer is set to 30 μm or less, preferably to 27 μm or less, and more preferably to 23 μm or less. The thickness of the coating layer is defined as the thickness per side of the steel sheet.

As mentioned above, the coating layer includes the intermetallic compound layer formed on a surface of the steel sheet and the metal layer formed on a surface of the intermetallic compound layer. The coating layer may be formed of the intermetallic compound layer and the metal layer.

The thickness of the coating layer in the hot press forming steel sheet can be measured by the method described in Examples. In a case in which the coating layer is provided on both sides of the steel sheet, the thickness of the coating layer on each side is 10 μm to 30 μm. However, the thickness of the coating layer on one side may be the same as or different from that on the other side. Here, the thickness of the coating layer can also be referred to as the total thickness of the intermetallic compound layer and the metal layer. Additionally, the thickness of the coating layer can be measured by observing the cross-section of the hot press forming steel sheet with a scanning electron microscope (SEM). More specifically, the thickness of the coating layer can be measured by the method described in Examples.

An oxide layer may further be present on a surface of the coating layer. Furthermore, a lower layer coating or an upper layer coating may also be provided depending on the purpose to the extent that it does not affect the actions and effects of the present disclosure. For example, a base coating layer composed mainly of Fe or Ni is exemplified as the lower layer coating. Examples of the upper layer coating may include a post-coating layer composed mainly of Ni and a chemical conversion treatment coating containing phosphate, a zirconium compound, a titanium compound, or the like.

According to the hot press forming steel sheet according to the present disclosure that satisfies the above conditions, the hot pressed member obtained after hot pressing has both excellent corrosion resistance at lapped part and post-painting corrosion resistance.

In an embodiment of the present disclosure, the coating layer can contain optionally added components to the extent that they do not impair the effects of the present disclosure. The optionally added components include, for example, at least one selected from the group consisting of Ca, Sr, Mn, V, Cr, Mo, Ti, Ni, Co, Sb, Zr, and B. The amount of the optionally added elements is not particularly limited, but the total content of the optionally added elements in the coating layer is preferably 2% or less. These elements are not essential and can be optionally included in the coating layer. Accordingly, the lower limit of the total content of these elements is not particularly limited and may be 0%.

In addition to the aforementioned components, the coating layer may further contain impurities that are inevitably mixed in during the production process. The composition of the entire coating layer can be measured, by analyzing the solution obtained by dissolving the coating layer with hydrochloric acid to which a pickling inhibitor has been added.

(3) Method of Producing Hot Pressed Member

Next, a suitable method of producing a hot pressed member according to the present disclosure will be described.

In an embodiment of the present disclosure, a hot pressed member is produced by hot pressing the hot press forming coated steel sheet described above. As described above, fine Mg-containing oxide particles are formed, by hot pressing the hot press forming steel sheet in which the cross-sectional area ratio of Al—$Mg_2Si$ pseudo binary eutectic microstructures is 60% or more under general conditions, and consequently a hot pressed member that satisfies the above conditions can be obtained.

Accordingly, a method of hot pressing is not particularly limited, and it can be performed in accordance with a conventional method. Typically, the hot press forming steel sheet is heated to a predetermined heating temperature (heating process), and subsequently the hot press forming steel sheet heated in the heating process is hot pressed (hot press process). Preferred conditions of hot pressing will be described below.

[Heating]

When the heating temperature in the heating process is lower than the $Ac_3$ transformation temperature of the base steel sheet, the strength of the final hot pressed member will be lower. Accordingly, the heating temperature is set preferably to more than or equal to the $Ac_3$ transformation temperature of the base steel sheet, and more preferably to 860° C. or more. On the other hand, when the heating temperature exceeds 1000° C., the oxide layer produced by oxidation of the base steel sheet and the coating layer becomes excessively thick, and this may degrade coating adhesion properties of the resulting hot pressed member. Accordingly, the heating temperature is set preferably to 1000° C. or less, more preferably to 960° C. or less, and even more preferably to 920° C. or less. Additionally, the $Ac_3$ transformation temperature of the base steel sheet depends on the steel composition, but it is determined by Formaster testing.

Although the temperature at which the heating is started is not particularly limited, it is generally room temperature.

The amount of time (heating time) taken to reach the heating temperature from the start of heating is not particularly limited and can be any time. However, when the heating time exceeds 300 seconds, the oxide layer produced by oxidation of the base metal and the coating layer becomes excessively thick because of longer exposure time to the high temperature. Accordingly, from the viewpoint of reducing the deterioration of coating adhesion properties due to oxides, the heating time is set preferably to 300 seconds or less, more preferably to 270 seconds or less, and even more preferably to 240 seconds or less. On the other hand, when the heating time is less than 150 seconds, a covering layer may melt excessively during the heating process, thus possibly resulting in staining of a heating device and a press mold. Accordingly, from the viewpoint of further enhancing the effect of preventing the staining of the heating device and the press mold, the heating time is set preferably to 150 seconds or more, more preferably to 180 seconds or more, and even more preferably to 210 seconds or more.

After the heating temperature is reached, it may be held at the heating temperature. In a case in which it is held, the holding time is not particularly limited and can be any length of time. However, when the holding time exceeds 300 seconds, the oxide layer produced by oxidation of the base metal and the covering layer becomes excessively thick, and this may degrade coating adhesion properties of the resulting hot pressed member. Accordingly, the holding time is set preferably to 300 seconds or less, more preferably to 210 seconds or less, and even more preferably to 120 seconds or less. On the other hand, since the holding process is optional, the holding time may be 0 seconds. However, from the viewpoint of homogeneously austenitizing the base steel sheet, it is preferable to set the holding time to 10 seconds or more.

The atmosphere in the heating process is not particularly limited, and heating can be performed in any atmosphere. The heating may be performed, for example, in an air atmosphere or under an atmosphere in which the air atmosphere flows. From the viewpoint of reducing the diffusible hydrogen content remaining in a member after hot pressing, it is preferable to set the dew point of the atmosphere to 0° C. or less. The lower limit of the dew point is also not particularly limited, but to keep the dew point less than −40° C., special equipment is required so as to prevent the inflow of air from the outside and to maintain a low dew point, which increases costs. Accordingly, from the viewpoint of cost, the dew point is set preferably to −40° C. or more, and more preferably to −20° C. or more.

A method of heating the hot press forming steel sheet is not particularly limited, and heating can be performed by any method. The heating can be performed, for example, by furnace heating, electrical resistance heating, induction heating, high-frequency heating, flame heating, or the like. Any heating furnace, such as an electric furnace or a gas furnace, can be used as the heating furnace.

[Hot Pressing]

After the heating, the steel sheet is subjected to hot press working to thereby obtain a hot pressed member. In the hot pressing, cooling is performed using a press mold or a refrigerant, such as water, at the same time as or immediately after the working. In the present disclosure, conditions of hot pressing are not particularly limited. For example, the pressing can be performed at 600° C. to 800° C., which is a general hot pressing temperature range.

(4) Method of Producing Hot Press Forming Steel Sheet

Next, a preferred method of producing a hot press forming steel sheet according to the present disclosure will be described.

In an embodiment of the present disclosure, a hot press forming steel sheet that satisfies the above conditions can be produced, by subjecting a steel sheet to hot dip coating using a molten bath with a predetermined chemical composition and removing the steel sheet from the molten bath, and subsequently cooling the steel sheet at a predetermined rate. Specific conditions will be described below.

[Steel Sheet]

Any steel sheet can be used as the steel sheet without any particular limitation. The chemical composition of the steel sheet is not particularly limited, but it is preferably the same as the aforementioned preferred chemical composition of steel material.

The steel sheet may be either a hot-rolled steel sheet or a cold-rolled steel sheet.

In a case in which a hot-rolled steel sheet is used as the steel sheet, the hot-rolled steel sheet can be produced in accordance with a conventional method. Typically, a steel slab as the material may be heated and then hot rolled. In the hot rolling, rough rolling and finishing rolling can be performed sequentially. Conditions, such as heating temperature when heating the steel slab and rolling finish temperature, are not particularly limited, and general conditions can be adopted.

After the hot rolling, it is preferable to perform pickling. The pickling can be performed in accordance with a conventional method. Acids that can be used for the pickling include, for example, hydrochloric acid and sulfuric acid.

In a case in which a cold-rolled steel sheet is used as the steel sheet, cold rolling may be further performed after the pickling, in accordance with a conventional method. The rolling reduction ratio in the cold rolling is not particularly limited, but from the viewpoint of mechanical properties of the steel sheet, it is preferably set to 30% or more. Furthermore, from the viewpoint of rolling cost, it is preferably set to 90% or less.

The steel sheet may be subjected to recrystallization annealing prior to hot dip coating. Conditions of the recrystallization annealing are also not particularly limited and can be performed in accordance with a conventional method. For example, after performing purification treatment, such as degreasing, on the steel sheet, the steel sheet can be heat-treated to a predetermined steel sheet temperature using an annealing furnace in an upstream heating zone, and then predetermined heat treatment can be performed in a downstream soaking zone. The atmosphere in the annealing furnace is not particularly limited, but a reducing atmosphere is preferred so as to activate a surface layer of the steel sheet.

[Hot Dip Coating]

In the present disclosure, the steel sheet is immersed in a hot dip molten bath to thereby form a coating layer. As the hot dip molten bath, it is necessary to use a hot dip molten bath with the following chemical composition. The reasons for this will be described below.

The chemical composition containing

Si: 3% to 7%,

Mg: 6% to 12%, and

Fe: 0% to 10%, with the balance being Al and inevitable impurities, where Mg/Si, which is the mass percent concentration ratio of Mg and Si, is 1.1 to 3.0.

Si: 3% to 7%

Si is an element that reacts with Mg to form $Mg_2Si$. When the Si content in the molten bath is less than 3%, the cross-sectional area ratio of Al—$Mg_2Si$ pseudo binary eutectic microstructures cannot be 60% or more. Accordingly, the S content is set to 3% or more. On the other hand, when the Si content is more than 7%, large size lumps of $Mg_2Si$ precipitate, and the cross-sectional area ratio of Al—$Mg_2Si$ pseudo binary eutectic microstructures can still not be 60% or more. Accordingly, the S content is set to 7% or less.

Mg: 6% to 12%

Mg is an element that reacts with Si to form $Mg_2Si$. When the Mg content in the molten bath is less than 6%, the cross-sectional area ratio of Al—$Mg_2Si$ pseudo binary eutectic microstructures cannot be 60% or more. Accordingly, the Mg content is set to 6% or more. On the other hand, when the Mg content is more than 12%, the cross-sectional area ratio of Al—$Mg_2Si$ pseudo binary eutectic microstructures can still not be 60% or more. Accordingly, the Mg content is set to 12% or less.

Fe: 0% to 10%

Fe is a component present in the bath as a result of dissolution from the steel sheet or bath equipment. When the Fe content in the molten bath exceeds 10%, the amount of dross in the bath becomes excessive, and this may deteriorate appearance quality due to adhesion to the coated steel sheet. Accordingly, the Fe concentration in the molten bath is set to 10% or less, preferably to 5% or less, and more preferably to 3% or less. From the viewpoint of appearance quality, the lower the Fe concentration in the molten bath, the better. Accordingly, the lower limit of the Fe content in the molten bath is set to 0%. Additionally, even when the Fe content in the molten bath is 0%, an intermetallic compound layer is formed by reaction between a steel substrate and components of the molten bath during hot dip coating.

Mg/Si: 1.1 to 3.0

Mg and Si are elements that react to form $Mg_2Si$, but when the ratio of Mg and Si is not in an appropriate range, the cross-sectional area ratio of Al—$Mg_2Si$ pseudo binary eutectic microstructures cannot be 60% or more. Accordingly, Mg/Si, which is the mass percent concentration ratio of Mg and Si in the molten bath, is set to 1.1 or more and 3.0 or less.

In another embodiment of the present disclosure, the chemical composition of the hot dip molten bath may further optionally contain at least one selected from the group consisting of Mn, V, Cr, Mo, Ti, Ni, Co, Sb, Zr, and B, where the total content thereof is 2% or less.

The temperature of the molten bath is preferably in the range of (solidification start temperature+20) ° C. to 700° C. When the temperature of the molten bath is more than or equal to the (solidification start temperature+20) ° C., local solidification of components caused by local temperature drop in the molten bath can be prevented. On the other hand, when the temperature of the molten bath is 700° C. or less, rapid cooling after coating is easier, and excessive thickening of the intermetallic compound layer formed between the steel sheet and the metal layer can be prevented.

Additionally, the temperature of the base steel sheet entering the molten bath (entering sheet temperature) is not particularly limited and may be any temperature. It is, however, preferable to control it within +20° C. of the temperature of the molten bath in order to ensure coating characteristics in continuous hot dip coating operation and to prevent changes in bath temperature.

The immersion time of the steel sheet in the hot dip molten bath is not particularly limited, but from the viewpoint of ensuring a stable thickness of the coating layer, it is preferably set to 1 second or more. On the other hand, the upper limit of the immersion time is not particularly limited, but from the viewpoint of preventing excessive thickening of the intermetallic compound layer formed between the steel sheet and the metal layer, it is preferable to set the immersion time to 5 seconds or less.

Additionally, immersion conditions of the base steel sheet in the molten bath are not particularly limited, and a line speed of approximately 40 mpm to 230 mpm is preferred, and an immersion length of approximately 5 μm to 7 μm is preferred.

Average Cooling Rate: 15° C./s or More

Next, the steel sheet is removed from the hot dip molten bath and subsequently cooled at an average cooling rate of 15° C./s or more. When the average cooling rate is less than 15° C./s, coarse lumpy $Mg_2Si$ is formed, and as a result, the cross-sectional area ratio of Al—$Mg_2Si$ pseudo binary eutectic microstructures cannot be 60% or more. Rapid cooling at an average cooling rate of 15° C./s or more prevents the formation of coarse lumpy $Mg_2Si$, and the cross-sectional area ratio of Al—$Mg_2Si$ pseudo binary eutectic microstructures can be 60% or more. Accordingly, the average cooling rate is set to 15° C./s or more, and preferably 20° C./s or more.

On the other hand, the upper limit of the average cooling rate is not particularly limited. However, in order to achieve an average cooling rate of more than 50° C./s, helium gas cooling and other means are required, which increases production costs. Accordingly, the average cooling rate is preferably set to 50° C./s or less.

A method of the cooling is not particularly limited and may be any method. From the viewpoint of cost, it is preferable to use nitrogen gas cooling for the cooling treatment. This is because nitrogen gas cooling can be performed with simple equipment and is superior in terms of economic efficiency.

In the cooling, it is preferable to cool the hot dip coated steel sheet to a temperature less than or equal to the solidification point of the hot dip molten bath. In other words, the cooling stop temperature in the cooling is preferably set to less than or equal to the solidification point of the hot dip molten bath. The lower limit of the cooling stop temperature is not limited, but it may be room temperature.

Although not particularly limited, it is preferable to produce the hot press forming steel sheet in a continuous hot dip coating line. As the continuous coating line, either a continuous coating line with a non-oxidizing furnace or a continuous coating line without a non-oxidizing furnace can be used. The hot press forming steel sheet according to the present disclosure is also excellent in terms of productivity, because it does not require special equipment and can be implemented using a general hot dip coating line as described above.

EXAMPLES

The actions and effects of the present disclosure will be described below using Examples. However, the present disclosure is not limited to the following Examples.

Preparation of Hot Press Forming Steel Sheets

First, steel sheets were subjected to hot dip coating in accordance with the following procedure, to thereby produce hot press forming steel sheets.

Cold-rolled steel sheets with a thickness of 1.4 mm were used as base steel sheets. The cold-rolled steel sheets each had a chemical composition containing C: 0.34%, Si: 0.25%, Mn: 1.20%, P: 0.02%, S: 0.001%, Al: 0.03%, N: 0.004%, Ti: 0.02%, B: 0.002%, Cr: 0.18%, and Sb: 0.008%, with the balance being Fe and inevitable impurities. The $Ac_3$ transformation point of the steel sheet was 783° C., and the $Ar_3$ transformation point was 706° C.

The base steel sheets were immersed into hot dip molten baths with the chemical compositions presented in Table 1 so as to be hot dip coated. The bath temperature of the hot dip molten baths used was 630° C. After removing the steel sheets from the hot dip molten baths, the coating layers were solidified by cooling at average cooling rates presented in Table 1, and thus, hot press forming steel sheets were obtained. The cooling was performed by $N_2$ gas wiping.

Subsequently, the thickness of the coating layer, the presence of intermetallic compound layer, and the cross-sectional area ratio of Al—$Mg_2Si$ pseudo binary eutectic microstructures in the metal layer were evaluated for each of the obtained hot press forming steel sheets in accordance with the following procedures. Evaluation results are presented in Table 1.

(Thickness of Coating Layer)

For each hot press forming steel sheet, the cross-section was observed with an SEM, and reflected electron images were obtained. The observation was made in five randomly selected fields of view at 500 times magnification. The obtained reflected electron images were subjected to image interpretation based on contrast, and the areas of the coating layer in the fields of view were calculated and divided by the widths of the fields of view, to thereby obtain the average thicknesses of the coating layer in the fields of view. The arithmetic mean of the average thicknesses in the five fields of views was considered as the thickness of the coating layer of the hot press forming steel sheet.

(Intermetallic Compound Layer)

The presence of intermetallic compound layer was identified by X-ray diffraction. Specifically, a diffraction figure was first obtained by measurement using an X-ray diffractometer with an ordinary 2θ-θ goniometer. The measurement was performed using Cu-Kα radiation under the conditions where the accelerating voltage was 40 kV and the current was 200 mA. In the obtained diffraction figure, it was assumed that the height of main peak of any intermetallic compound among $Fe_2Al_5$, $Fe_2Al_5Si$, $Fe_4Al_{13}$, and $FeAl_3$ was P1, and the height of main peak of Al, which is the main component of eutectic microstructures, was P2, and when the peak ratio P1/(P1+P2) was more than 0.02, the coating layer of the hot press forming steel sheet was determined to have an intermetallic compound layer containing that intermetallic compound. In a case in which an intermetallic compound layer consisting of at least one selected from the group consisting of $Fe_2Al_5$, $Fe_2Al_5Si$, $Fe_4Al_{13}$, and $FeAl_3$ was present, "present" was noted in the "intermetallic compound layer" column in Table 1.

Additionally, the main peaks of $Fe_2Al_5$, $Fe_2Al_5Si$, $Fe_4Al_{13}$, and $FeAl_3$ are observed to overlap between 2θ=42° to 44° and are broad, thus making it sometimes difficult to identify them separately. In this case, P1 was defined as the intensity of the main peak between 2°=42° to 44°, and when P1/(P1+P2) exceeds 0.02, it was determined that any one of the intermetallic compounds $Fe_2Al_5$, $Fe_2Al_5Si$, $Fe_4Al_{13}$, and $FeAl_3$ was present.

(Cross-Sectional Area Ratio of Eutectic Microstructures)

The cross-sectional area ratio of Al—$Mg_2Si$ pseudo binary eutectic microstructures in the metal layer was measured using a scanning electron microscope (SEM) and an energy dispersive elemental analyzer (EDS). For the measurement, a test piece taken from each hot press forming steel sheet was embedded in resin and used as a sample for cross-sectional observation, and elemental mapping was obtained in a 100-μm-wide field of view in the cross-section of the hot press forming steel sheet. The atomic percent concentrations of Al, Si, and Mg analyzed by the ZAF method were respectively $m_{Al}$, $m_{Si}$, and $m_{Mg}$. A region that satisfied $m_{Al}+m_{Si}+m_{Mg}\geq 70\%$, $1.5\leq m_{Mg}/m_{Si}\leq 2.5$, and $0.1\leq (m_{Si}+m_{Mg})/m_{Al}\leq 0.3$ was defined as Al—$Mg_2Si$ pseudo binary eutectic microstructures. The area of the Al—$Mg_2Si$ pseudo binary eutectic microstructures was measured and divided by the total area of the metal layer, to thereby obtain the cross-sectional area ratio of the Al—$Mg_2Si$ pseudo binary eutectic microstructures in the metal layer.

Preparation of Hot Pressed Member

After that, the obtained hot press forming steel sheets were hot pressed in accordance with the following procedure, to thereby produce hot pressed members. First, 100 mm×200 mm test pieces were taken from the hot press forming steel sheets and heat-treated by an electric furnace. In the heat treatment, the heating temperature was set to 910° C., the heating time was set to 210 seconds, and the holding time was set to 60 seconds. The heating was performed in an atmosphere with a dew point of 15° C.

After the holding time had elapsed, the test pieces were removed from the electric furnace and immediately hot pressed at a molding start temperature of 720° C. using a hat-type press mold, and thus, hot pressed members were obtained. The obtained hot pressed members had a shape in which a flat portion on an upper surface had a length of 100 mm, a flat portion on a side surface had a length of 30 mm, and a flat portion on a bottom surface had a length of 20 mm. The curvature radius R of the press mold was 7R for both top shoulders and bottom shoulders.

The thickness of the Al—Fe-based intermetallic compound layer, and the average particle size and the number density of Mg-containing oxide particles on the Al—Fe-based intermetallic compound layer were measured for each of the obtained hot pressed members in accordance with the following method. Measurement results are presented in Table 2.

(Thickness of Al—Fe-Based Intermetallic Compound Layer)

The cross-section of a surface layer of a top portion of each obtained hot pressed member was observed with an SEM, and reflected electron images were obtained. The observation was made in five randomly selected fields of view at 500 times magnification. The obtained reflected electron images were subjected to image interpretation based on contrast, and the areas of the Al—Fe-based intermetallic compound layer in the fields of view were calculated and divided by the widths of the fields of view, to thereby obtain the average thicknesses of the Al—Fe-based intermetallic compound layer in the fields of view. The arithmetic mean of the average thicknesses in the five fields views was considered as a representative value of the thickness of the Al—Fe-based intermetallic compound layer in the hot pressed member.

(Average Particle Size and Number Density of Mg-Containing Oxide Particles)

The surface of the top portion of the obtained hot pressed member was observed with a scanning electron microscope (SEM), and reflected electron images were obtained. The observation was made in five randomly selected fields of view at 1000 times magnification. The obtained reflected electron images were subjected to image interpretation, and the average particle size and the number density of oxide particles were calculated. In calculating the average particle size, the minor axis length and the major axis length of an individual oxide particle were first measured, and an average value of the minor axis length and the major axis length was considered as the diameter of the oxide particle. Then, the average value of all oxide particles observed in the fields of view was determined. The number density was calculated by dividing the sum of the numbers of oxide particles observed in the respective fields of view by the total area of all the fields of view.

Furthermore, to evaluate the characteristics of the obtained hot pressed members, corrosion resistance at lapped part and post-painting corrosion resistance were evaluated under the following conditions.

(Corrosion Resistance at Lapped Part)

First, "test pieces for evaluating corrosion resistance at lapped part" were prepared from the obtained hot pressed members in accordance with the following procedure. First, a 40 mm×150 mm test piece was taken from the top portion of each hot press-formed member. The above test piece was welded to a galvannealed steel sheet (GA) as a mating member, to thereby form a joined test piece. The galvannealed steel sheet had a size of 70 mm×200 mm and a thickness of 0.8 mm. The welding was made by resistance spot welding at four points.

Subsequently, the lapped test pieces were sequentially subjected to zinc phosphate chemical conversion treatment and electrodeposition painting, to thereby obtain test pieces for evaluating corrosion resistance at lapped part. The zinc phosphate chemical conversion treatment was performed under standard conditions using PB-SX35 manufactured by Nihon Parkerizing Co., Ltd. The electrodeposition painting was performed using the cationic electrodeposition paint Electron GT100 manufactured by Kansai Paint Co., Ltd., to thereby form a 15-μm-thick painting film on all surfaces but the lapped surfaces.

The obtained test pieces for evaluating corrosion resistance at lapped part were subjected to corrosion tests (SAE-J2334), so as to evaluate corrosion conditions after 120 cycles. Specifically, the welded portions of the test pieces after the corrosion tests were first broken by a drill, so as to separate the hot pressed members from the galvannealed steel sheets. Then, iron rust formed on surfaces of the galvannealed steel sheets was removed in accordance with the method of removing corrosion products specified in ISO 8657. After that, corrosion depths of the base steel sheets were measured with a point micrometer, to thereby determine the maximum corrosion depths at joined surfaces. Based on the measured maximum corrosion depths, corrosion resistance at lapped part was evaluated in the following four levels. Evaluation results are presented in Table 2. Here, an evaluation result of 1 or 2 was considered acceptable.

1: maximum corrosion depth <0.2 mm

2: 0.2 mm≤maximum corrosion depth <0.4 mm

3: 0.4 mm≤maximum corrosion depth <0.8 mm

4: 0.8 mm≤maximum corrosion depth (with hole)

(Post-Painting Corrosion Resistance)

From the top portions of the obtained hot pressed members, 40 mm×150 mm flat test pieces were cut out, and the flat test pieces were subjected to zinc phosphate chemical conversion treatment and electrodeposition painting to thereby obtain corrosion resistance test pieces. The zinc phosphate chemical conversion treatment was performed under standard conditions using PB-SX35 manufactured by Nihon Parkerizing Co., Ltd., and the electrodeposition painting was performed using the cationic electrodeposition paint Electron GT100 manufactured Kansai Paint Co., Ltd. so that a painting film thickness of 5 μm was achieved.

The obtained corrosion resistance test pieces were subjected to corrosion tests (SAE-J2334), so as to evaluate corrosion conditions after 40 cycles. Based on red rust area ratios on painted surfaces, post-painting corrosion resistance was determined in the following four levels. An evaluation result of 1, 2, or 3 was considered acceptable. Evaluation results are presented in Table 2.

1: red rust area ratio <10%

2: 10%≤red rust area ratio <20%

3: 20%≤red rust area ratio <50%

4: 50%≤red rust area ratio

As can be seen from the results presented in Table 2, the hot pressed members that satisfy the conditions of the present disclosure had both excellent corrosion resistance at lapped part and post-painting corrosion resistance.

TABLE 1

| Production conditions of hot press forming steel sheet | | | | | | | | | | |
|---|---|---|---|---|---|---|---|---|---|---|
| | Production conditions of hot press forming steel sheet | | | | | | Hot press forming steel sheet | | | |
| | Chemical composition of molten bath | | | | | Cooling Average cooling | Thickness of | Presence of | Cross-sectional area ratio of eutectic | |
| No. | Al (mass %) | Si (mass %) | Mg (mass %) | Fe (mass %) | Mg/Si | rate (° C./s) | coating layer (μm) | intermetallic compound layer | microstructures (%) | Remarks |
| 1 | 87 | 4.0 | 7.0 | 2.0 | 1.8 | 20 | 20 | Present | 88 | Example |
| 2 | 81 | 4.0 | 7.0 | 8.0 | 1.8 | 20 | 20 | Present | 78 | Example |
| 3 | 84 | 8.0 | 6.0 | 2.0 | 0.8 | 20 | 20 | Present | 28 | Comparative Example |
| 4 | 88 | 10.0 | 0.0 | 2.0 | 0.0 | 20 | 20 | Present | 0 | Comparative Example |
| 5 | 88 | 10.0 | 0.3 | 2.0 | 0.0 | 20 | 20 | Present | 0 | Comparative Example |
| 6 | 87 | 4.0 | 7.0 | 2.0 | 1.8 | 16 | 20 | Present | 72 | Example |
| 7 | 87 | 4.0 | 7.0 | 2.0 | 1.8 | 5 | 20 | Present | 35 | Comparative Example |
| 8 | 87 | 4.0 | 7.0 | 2.0 | 1.8 | 20 | 2 | Present | 83 | Comparative Example |
| 9 | 87 | 4.0 | 7.0 | 2.0 | 1.8 | 20 | 11 | Present | 85 | Example |
| 10 | 87 | 4.0 | 7.0 | 2.0 | 1.8 | 20 | 28 | Present | 89 | Example |
| 11 | 85 | 4.1 | 7.5 | 3.3 | 1.8 | 20 | 19 | Present | 82 | Example |
| 12 | 87 | 4.3 | 8.0 | 1.2 | 1.9 | 20 | 22 | Present | 87 | Example |
| 13 | 86 | 4.7 | 8.5 | 0.5 | 1.8 | 20 | 25 | Present | 97 | Example |
| 14 | 84 | 5.2 | 9.0 | 1.7 | 1.7 | 20 | 28 | Present | 90 | Example |
| 15 | 84 | 3.6 | 10.0 | 2.0 | 2.8 | 20 | 20 | Present | 72 | Example |
| 16 | 84 | 3.2 | 11.0 | 2.0 | 3.4 | 20 | 20 | Present | 65 | Comparative Example |
| 17 | 87 | 6.5 | 5.0 | 2.0 | 0.8 | 20 | 20 | Present | 44 | Comparative Example |
| 18 | 89 | 2.0 | 7.0 | 2.0 | 3.5 | 20 | 20 | Present | 9 | Comparative Example |
| 19 | 88 | 3.2 | 7.0 | 2.0 | 2.2 | 20 | 20 | Present | 74 | Example |
| 20 | 85 | 6.3 | 7.0 | 2.0 | 1.1 | 20 | 20 | Present | 72 | Example |
| 21 | 78 | 9.0 | 11.0 | 2.0 | 1.2 | 20 | 20 | Present | 28 | Comparative Example |
| 22 | 88 | 3.5 | 6.2 | 2.0 | 1.8 | 20 | 20 | Present | 66 | Example |
| 23 | 89 | 4.0 | 5.0 | 2.0 | 1.3 | 20 | 20 | Present | 42 | Comparative Example |
| 24 | 83 | 4.0 | 11.0 | 2.0 | 2.8 | 20 | 20 | Present | 65 | Example |
| 25 | 79 | 6.0 | 13.0 | 2.0 | 2.2 | 20 | 20 | Present | 48 | Comparative Example |

TABLE 2

| Hot pressed member | | | | | | | |
|---|---|---|---|---|---|---|---|
| | Al—Fe-based intermetallic compound layer | | Mg-containing oxide particles | | Evaluation results | | |
| | Presence | Thickness (μm) | Average particle size (μm) | Number density (particles/mm$^2$) | corrosion resistance at lapped part | post-painting corrosion resistance | Remarks |
| 1 | Present | 22 | 3.3 | 1544 | 1 | 1 | Example |
| 2 | Present | 21 | 2.5 | 1587 | 1 | 1 | Example |
| 3 | Present | 24 | 8.8 | 359 | 3 | 4 | Comparative Example |
| 4 | Present | 19 | — | 0 | 4 | 1 | Comparative Example |
| 5 | Present | 17 | 3.0 | 6 | 4 | 1 | Comparative Example |
| 6 | Present | 21 | 3.8 | 1119 | 1 | 2 | Example |
| 7 | Present | 22 | 7.3 | 593 | 3 | 4 | Comparative Example |
| 8 | Present | 9 | 2.8 | 1535 | 1 | 4 | Comparative Example |
| 9 | Present | 11 | 2.4 | 1574 | 1 | 2 | Example |
| 10 | Present | 28 | 3.3 | 1559 | 1 | 1 | Example |
| 11 | Present | 20 | 4.2 | 3310 | 1 | 1 | Example |
| 12 | Present | 24 | 3.1 | 10960 | 1 | 1 | Example |
| 13 | Present | 24 | 4.6 | 18352 | 1 | 1 | Example |
| 14 | Present | 29 | 4.9 | 6605 | 1 | 1 | Example |
| 15 | Present | 23 | 4.3 | 1226 | 1 | 2 | Example |
| 16 | Present | 21 | 5.3 | 1133 | 1 | 3 | Comparative Example |
| 17 | Present | 17 | 3.0 | 881 | 3 | 2 | Comparative Example |
| 18 | Present | 22 | 2.4 | 181 | 3 | 1 | Comparative Example |
| 19 | Present | 24 | 3.2 | 1337 | 1 | 1 | Example |
| 20 | Present | 22 | 3.8 | 1153 | 1 | 1 | Example |
| 21 | Present | 23 | 23.5 | 273 | 3 | 4 | Comparative Example |
| 22 | Present | 21 | 2.8 | 1239 | 2 | 1 | Example |
| 23 | Present | 17 | 1.9 | 561 | 3 | 1 | Comparative Example |
| 24 | Present | 23 | 4.6 | 1843 | 1 | 2 | Example |
| 25 | Present | 18 | 15.9 | 333 | 3 | 4 | Comparative Example |

The invention claimed is:

1. A hot pressed member comprising:

a steel material;

an Al—Fe-based intermetallic compound layer with a thickness of 10 μm to 30 μm disposed on at least one side of the steel material; and Mg-containing oxide particles disposed on the Al—Fe-based intermetallic compound layer, wherein the Mg-containing oxide particles have an average particle size of 5.0 μm or less and a number density of 1000 particles/$mm^2$ or more, and the Al—Fe-based intermetallic compound layer consists of at least one selected from the group consisting of $FeAl_3$, $Fe_4Al_{13}$, $Fe_2Al_5$, FeAl, $Fe_3Al$, and $Fe_2Al_5Si$.

2. A method of producing the hot pressed member according to claim 1, the method comprising hot pressing a hot press forming steel sheet, wherein the hot press forming steel sheet comprises:

a steel sheet; and a coating layer with a thickness of 10 μm to 30 μm disposed on at least one side of the steel sheet, wherein the coating layer includes:

an intermetallic compound layer consisting of at least one selected from the group consisting of $Fe_2Al_5$, $Fe_2Al_5Si$, $Fe_4Al_{13}$, and $FeAl_3$ and disposed on the steel sheet; and a metal layer containing Al—$Mg_2Si$ pseudo binary eutectic microstructures and disposed on the intermetallic compound layer, and wherein the Al—$Mg_2Si$ pseudo binary eutectic microstructures in the metal layer have a cross-sectional area ratio of 60% or more.

* * * * *